US008596025B2

(12) United States Patent
Fulper

(10) Patent No.: US 8,596,025 B2
(45) Date of Patent: Dec. 3, 2013

(54) SYSTEMS AND METHODS FOR CAPSULE PRESSURE-RELIEF

(75) Inventor: Lester David Fulper, Clearwater, FL (US)

(73) Assignee: Patheon International AG, Baar Zug (CH)

( * ) Notice: Subject to any disclaimer, the term of this patent is extended or adjusted under 35 U.S.C. 154(b) by 266 days.

(21) Appl. No.: 12/788,534

(22) Filed: May 27, 2010

(65) Prior Publication Data

US 2011/0088355 A1 Apr. 21, 2011

Related U.S. Application Data

(60) Provisional application No. 61/182,277, filed on Jun. 1, 2009.

(51) Int. Cl.
*A61J 3/07* (2006.01)

(52) U.S. Cl.
USPC ..... 53/432; 43/485; 43/510; 43/329; 43/900

(58) Field of Classification Search
USPC ..... 53/432, 454, 484, 485, 510, 560, 287, 53/320, 329, 359, 900
IPC ..... A61J 3/07
See application file for complete search history.

(56) References Cited

U.S. PATENT DOCUMENTS

| | | | | |
|---|---|---|---|---|
| 2,108,906 | A * | 2/1938 | Speckhart et al. | 53/900 |
| 3,554,412 | A | 1/1971 | Hayashi et al. | |
| 4,403,461 | A * | 9/1983 | Goutard et al. | 53/900 |
| 4,731,979 | A | 3/1988 | Yamamoto et al. | |
| 4,940,499 | A | 7/1990 | Lebrun et al. | |
| 5,321,932 | A | 6/1994 | Sundberg | |
| 5,797,248 | A | 8/1998 | Hetherington et al. | |
| 6,286,567 | B1 | 9/2001 | Runft | |
| 6,901,972 | B1 | 6/2005 | Nelson | |
| 2005/0217207 | A1 * | 10/2005 | Konishi et al. | 53/560 |
| 2008/0141621 | A1 | 6/2008 | Funaro et al. | |
| 2010/0018167 | A1 * | 1/2010 | McCutcheon et al. | 53/478 |

FOREIGN PATENT DOCUMENTS

| | | |
|---|---|---|
| KR | 10-2005-0028012 | 3/2005 |
| WO | WO 2008/015519 | 2/2008 |

OTHER PUBLICATIONS

International Search Report PCT/US2010/036530 dated Feb. 9, 2011 (3 pgs.).

* cited by examiner

*Primary Examiner* — Stephen F Gerrity
(74) *Attorney, Agent, or Firm* — Fulbright & Jaworski, L.L.P.; Scott D. Rothenberger

(57) ABSTRACT

An system and method for coupling a capsule body and cap is provided. The system and method provide a first conduit configured to align a capsule body and a second conduit configured to align a capsule cap. The system and method provide for a pressure-relief cavity in at least one of the first conduit and the second conduit.

23 Claims, 18 Drawing Sheets

SYSTEMS AND METHODS FOR CAPSULE PRESSURE-RELIEF

CROSS REFERENCE TO RELATED APPLICATIONS

This application claims benefit of U.S. Provisional Patent Application No. 61/182,777, filed Jun. 1, 2009, entitled "Systems and Methods for Capsule Pressure-Relief", the contents of which are incorporated in their entirety herein by reference.

FIELD OF THE INVENTION

Embodiments of the present invention relate to systems and methods for relieving pressure in a capsule created when a capsule body and cap are coupled together to form a capsule.

BACKGROUND

Systems used to produce capsules containing medicine or other quantities of dosed material often comprise multiple stations configured to perform individual tasks needed to form the capsules. In certain embodiments, empty capsules are initially placed into a hopper. These capsules consist of a capsule body and cap. Empty capsules can then be rectified so that they are all in the same position, e.g. cap up and body down. The capsules can then be transferred from the rectification station to a transfer block.

In certain systems, the transfer block transfers the capsules from the rectification station to a cap disk or plate. There may also be a transfer block that moves between the cap plate and body plate. The capsule bodies can sucked down through this transfer block and deposited in the body disk. In specific systems, the caps are larger in diameter then the bodies, and are retained in the cap disk, causing the caps and bodies to be separated. In certain systems, the capsules can index past a station that removes any capsules where the bodies did not separate from the caps.

In some systems, the capsules may also index past a sensor that looks for missing caps or bodies. This will then determine if that segment of capsules will be filled or rejected. If any caps or bodies are missing the segment will not be filled and they will be sent to rejection when they reach the ejection station. Capsules may then index to the filling station where they are filled unless otherwise marked for rejection.

In specific systems, the capsules then index to the closing station. In this station, the capsule bodies and caps are joined together to form a capsule. In certain systems, closing pins push the capsule bodies into a closing block from the body plate. The closing block and closing pins can then move together up to the cap disk. In certain systems, the capsule bodies are initially towards the bottom of the cylinder or conduit that holds them in the closing block.

In certain systems, the closing pins can continue to move towards the cap plate until the capsule bodies are pushed into the capsule caps, thereby closing and locking the capsule. Capsules that are successfully formed continue to index around until they are pushed out at the ejection station.

In some existing systems, there is typically no way for air in the cylinder or conduit that is trapped between the capsule body and cap to escape as the body is moved towards the cap. The increase in pressure can contribute to capsules popping open or leakage on liquid filled capsules before the seal can be applied. This in turn soils the equipment and creates a cascade of additional problems that eventually cause the system to shut down. As a result, costs may be increased due to system downtime, higher maintenance, and lower product yield. A need therefore exists to relieve the pressure created when the capsule body and cap are brought together.

SUMMARY

Certain embodiments of the present disclosure include systems and methods for relieving pressure in a capsule created when a capsule body and cap are coupled together to form a capsule.

Certain embodiments comprise a system for coupling a cap and body of a capsule. The system may comprise a first component configured to retain a capsule body, where the first component comprises a first conduit configured to align a capsule body. The system may also comprise a second component configured to retain a capsule cap, where the second component comprises a second conduit configured to align a capsule cap. The system may also comprise a pressure-relief cavity in at least one of the first conduit or the second conduit.

Embodiments of the system may also comprise a rod displaced within the first conduit, where the system is configured to actuate the rod and displace the capsule body within the first conduit. In certain embodiments, the system is configured to actuate the rod toward the second component. In specific embodiments, the pressure-relief cavity is coupled to a vacuum source. In certain embodiments, the pressure-relief cavity is vented to the atmosphere.

In certain embodiments of the system, the pressure-relief cavity comprises an axial channel in the first conduit. The pressure-relief cavity may also comprise a third conduit in fluid communication with the first conduit and the atmosphere.

Exemplary embodiments may also comprise a system for coupling a cap and body of a capsule, where the system comprises: a first block comprising a first engagement surface; a first plate comprising a second engagement surface; a first conduit extending from the first engagement surface into the first block; and a second conduit extending from the second engagement surface into the first plate. In specific embodiments, the system is configured to move the first engagement surface toward the second engagement surface and away from the second engagement surface. In exemplary embodiments, the first conduit comprises a pressure-relief cavity, and the pressure-relief cavity may be vented to atmosphere or coupled to a vacuum source.

In particular embodiments, the first block comprises a seal extending partially around the perimeter of the block. In certain embodiments, the first block comprises a chamber coupled to the vacuum source. In exemplary embodiments, the pressure-relief cavity comprises an axial channel in the first conduit. The pressure-relief cavity may also be formed by a third conduit from an outer wall of the first block to the first conduit. In certain embodiments, the pressure relief cavity is proximal to the first engagement surface.

Embodiments of the present disclosure may also comprise a system for coupling a cap and body of a capsule, where the system comprises: a first block comprising a first engagement surface; a first plate comprising a second engagement surface; a first conduit extending from the first engagement surface into the first block; and a second conduit extending from the second engagement surface into the first plate. In certain embodiments, the system is configured to move the first block toward the first plate and away from the first plate. A first portion of the first conduit may comprise a circular cross-section, and a second portion of the first conduit may comprise a non-circular cross-section. In certain embodiments, the second portion of the first conduit is vented to the atmosphere. In particular embodiments, the second portion of the first conduit is coupled to a vacuum source.

In specific embodiments, the second portion of the first conduit comprises an axial channel. In certain embodiments, the second portion of the first conduit comprises an aperture in the wall of the first conduit. In particular embodiments, the second portion of the first conduit is proximal to the first engagement surface.

Embodiments of the present disclosure may also comprise a method of coupling a capsule cap and a capsule body. In certain embodiments, the method comprises providing a first component configured to retain a capsule body, where the first component comprises a first conduit configured to align a capsule body. Exemplary embodiments may also comprise providing a second component configured to retain a capsule cap, where the second component comprises a second conduit configured to align a capsule body. The method may also comprise providing a pressure-relief cavity in at least one of the first conduit and the second conduit and moving at least one of the capsule cap and the capsule body within the first conduit and the second conduit. In certain embodiments, the method comprises displacing air from the first or second conduit via the pressure-relief cavity.

In particular embodiments, displacing air from the first or second conduit via the pressure-relief cavity comprises venting air from the first or second conduit via the pressure-relief cavity to atmosphere. In certain embodiments, displacing air from the first or second conduit via the pressure-relief cavity comprises directing the air to a vacuum source.

Other advantages and features may become apparent from the following description, drawings, and claims.

DETAILED DESCRIPTION

Embodiments of the present disclosure comprise a system for coupling a cap and body of a capsule. Referring initially to FIGS. 1-4, an exemplary embodiment of a system 100 for coupling a capsule cap and body is shown.

Figure 1:
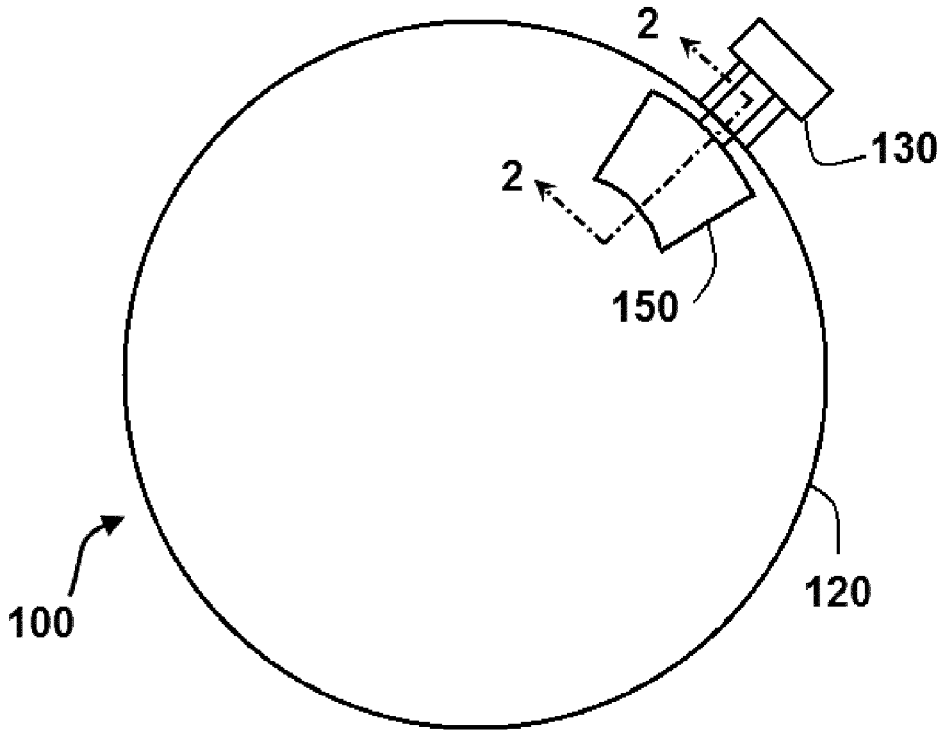
FIG. 1 shows a top view of a system according to one or more examples of embodiments of the present invention.

Referring now to FIG. 1, a top view of system 100 shows cap plate 120, backing block 150 and actuator 130. In certain embodiments, cap plate 120 is configured to rotate so that other functions can be performed on the cap and body of the capsules. For example, other stations may comprise aligning the caps and bodies and filling the capsule bodies and/or caps. For purposes of this disclosure, the primary discussion will be focused on a system to couple the caps and bodies of the capsules. It is understood that embodiments of the present disclosure may be part of a larger system that includes other functions.

Figure 2A:
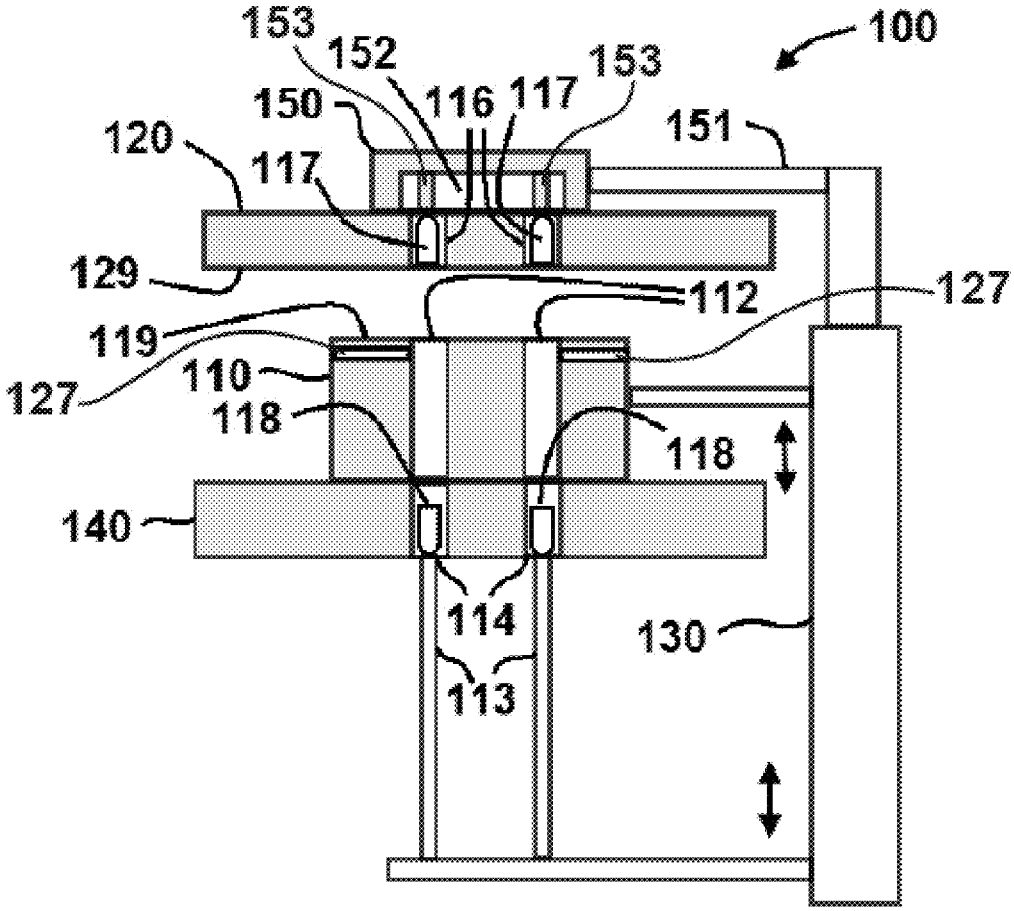
FIG. 2A shows a section view of the embodiment of FIG. 1 in a first position.
Figure 2B:
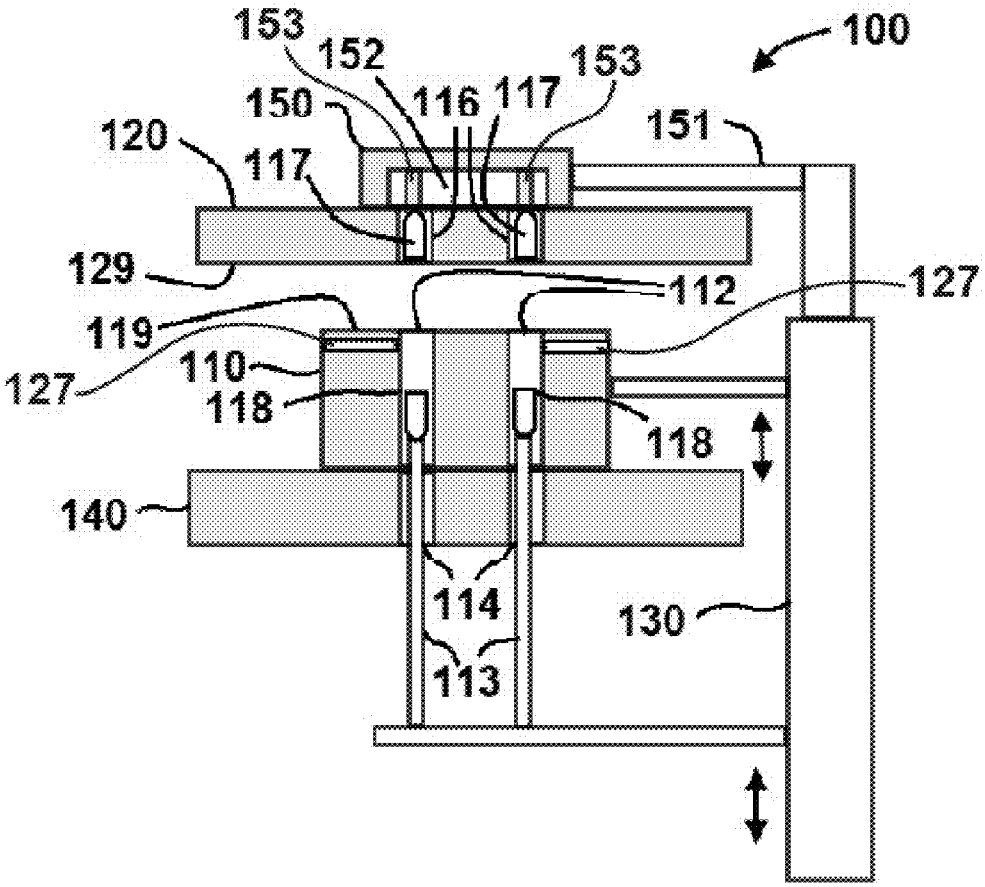
FIG. 2B shows a section view of the embodiment of FIG. 1 in a second position.
Figure 2C:
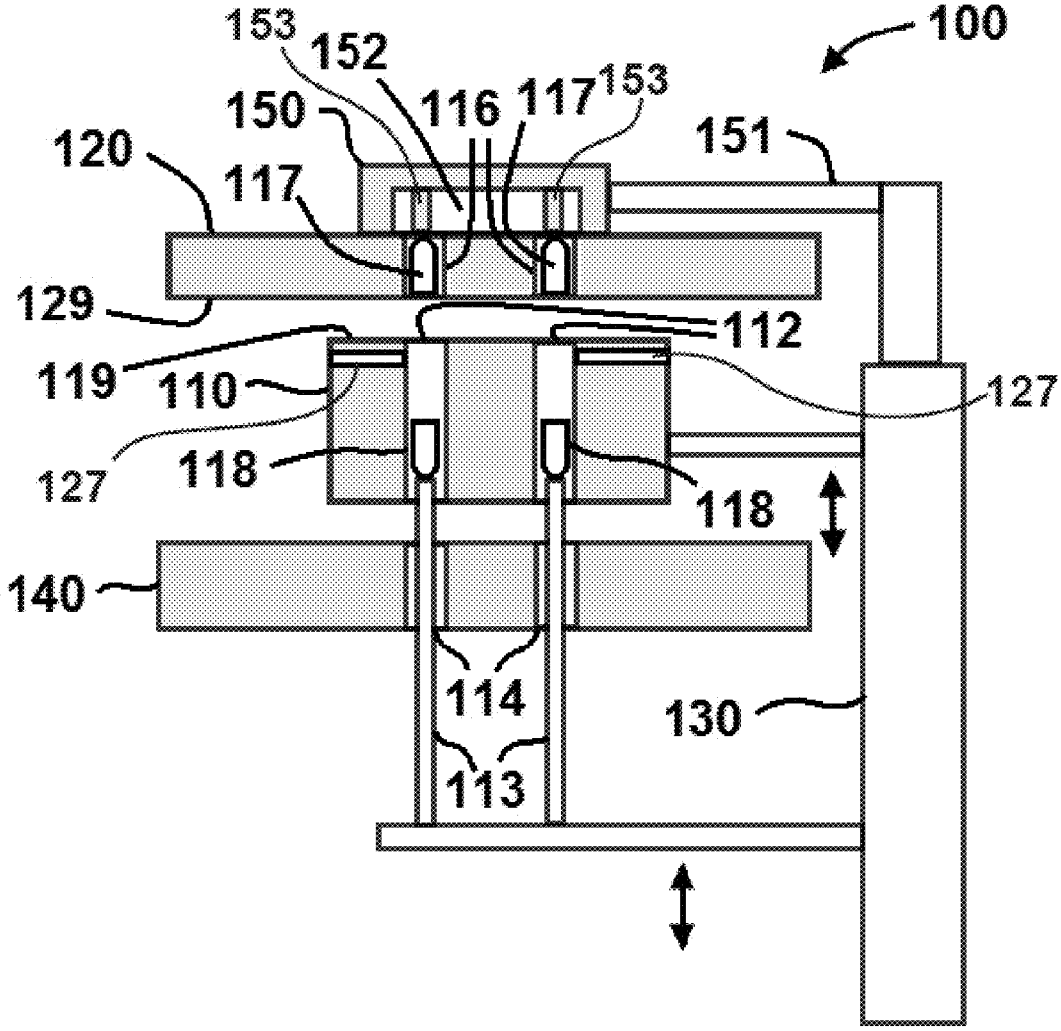
FIG. 2C shows a section view of the embodiment of FIG. 1 in a third position.

Referring now to FIG. 2A, a section of system 100 taken along line 2-2 in FIG. 1 reveals components not visible from the top view of FIG. 1. For example, system 100 comprises a closing block 110, a cap plate 120, a body plate 140, and a backing block 150. As explained in more detail below, FIGS. 2A-4 show components of system 100 in various positions as the capsule body is coupled to the capsule cap.

As shown in FIGS. 2A-4, closing block 110 comprises an engagement surface 119 that is proximal to an engagement surface 129 of cap plate 120. Closing block 110 further comprises a plurality of conduits 112 extending from engagement surface 119 into closing block 110. In the embodiment shown, conduits 112 extend through closing block 110 and are aligned with a plurality of conduits 114 in body plate 114 and a plurality of conduits 116 in cap plate 120. A plurality of rods 113 are configured to extend into and through conduits 114 and 112.

In this embodiment, system 100 also comprises an actuator 130 configured to move closing block 110 toward and away from cap plate 120. In the embodiment shown in FIGS. 2A-4, actuator 130 is also configured to move rods 113 so that they may be directed into conduits 112 or retracted out of conduits 112. In other embodiments, rods 113 may be moved by an actuator that is separate from actuator 130.

Figure 2D:
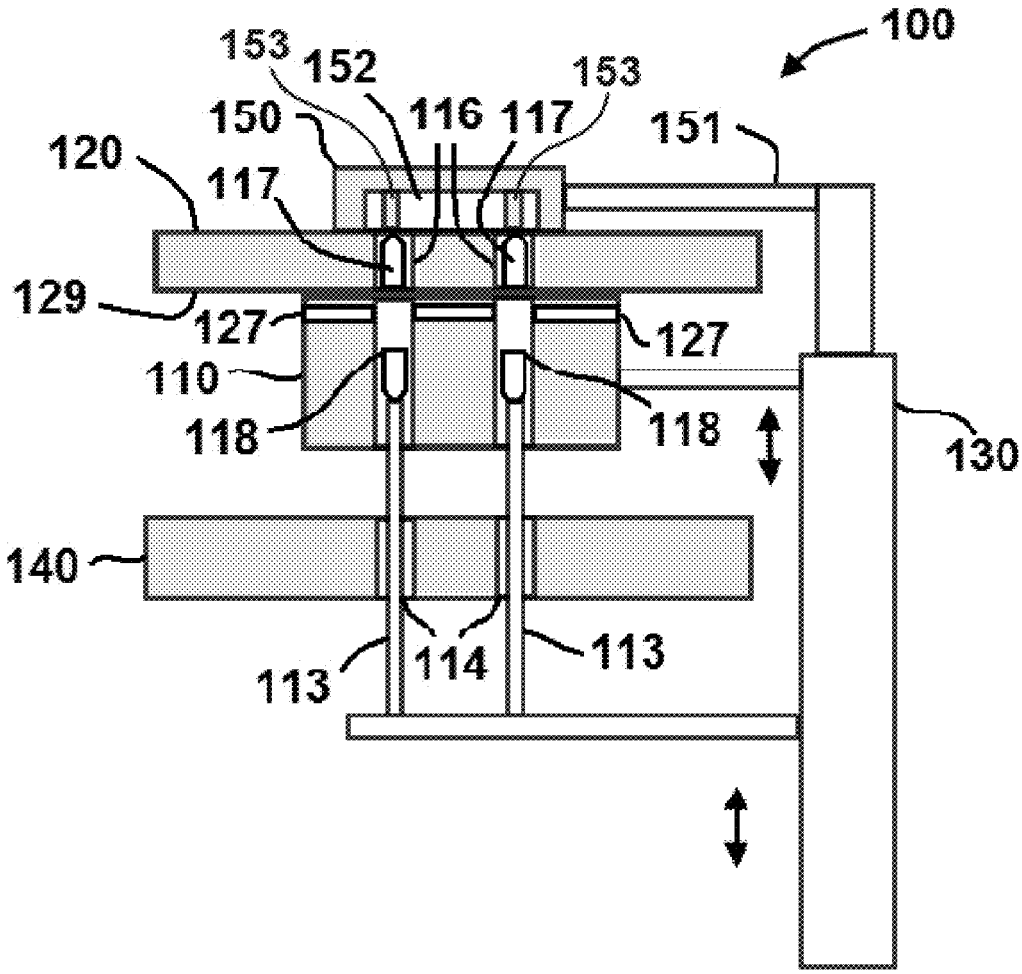
FIG. 2D shows a section view of the embodiment of FIG. 1 in a fourth position.
Figure 3:
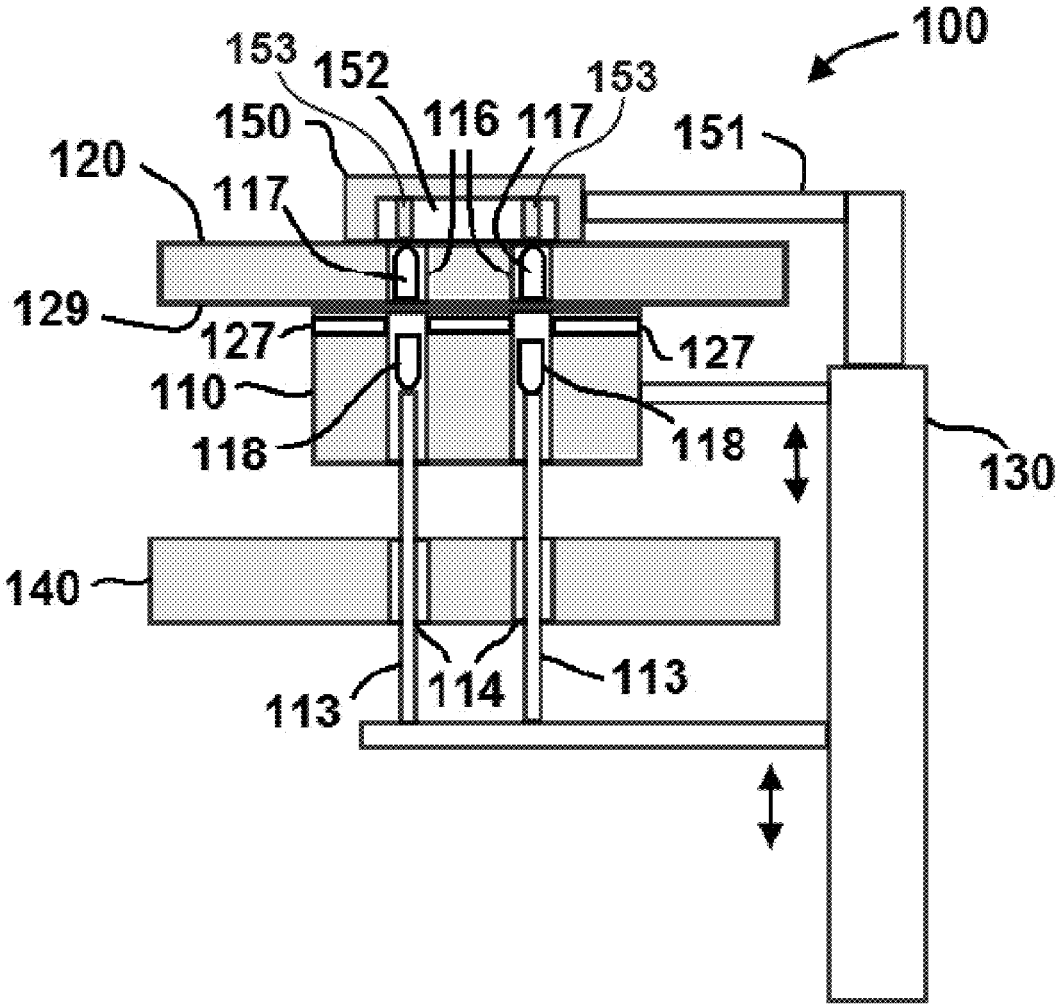
FIG. 3 shows a section view of the embodiment of FIG. 1 in a fifth position.
Figure 4:
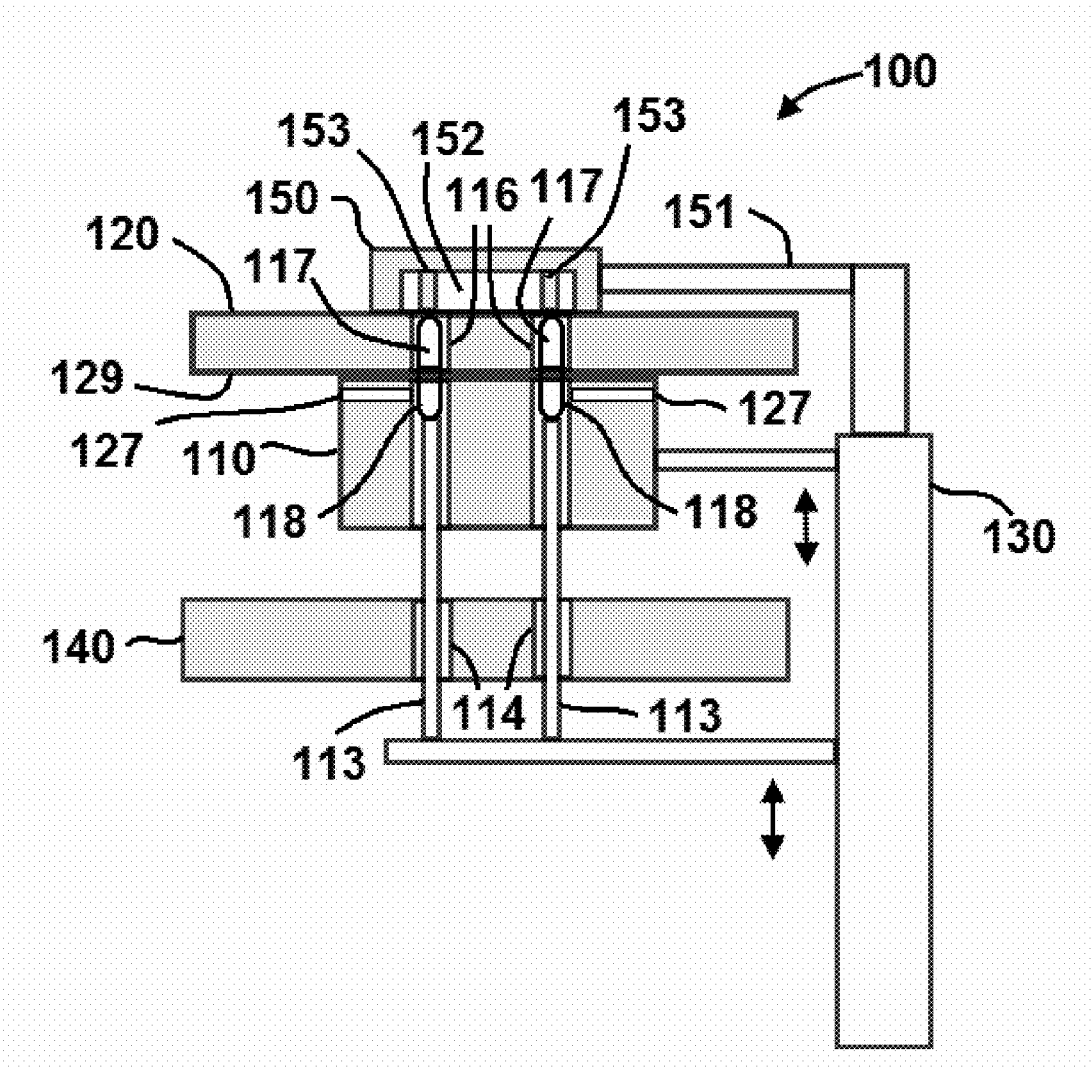
FIG. 4 shows a section view of the embodiment of FIG. 1 in a sixth position.

During operation, a capsule body 118 may be placed in one or more conduits 112 and a capsule cap 117 may be placed in one or more conduits 116. In specific embodiments, capsule bodies 118 may originally be placed in conduits 114 of body plate 140 (as shown in FIG. 2A) and then be pushed into conduits 112 by rods 113. In this embodiment, actuator 130 moves closing block 110 towards cap plate 120 until engagement surface 119 contacts engagement surface 129, as shown in FIG. 2D. In addition, actuator 130 moves rods 113 so that capsule bodies 118 are directed towards toward capsule caps 117, as shown in FIG. 3. In the embodiment shown, actuator 130 continues moving rods 113 until capsule bodies 118 are coupled to capsule caps 117, as shown in FIG. 4.

During operation of system 100, the movement of capsule bodies 118 in conduits 112 can cause air to be displaced from conduits 112 towards engagement surface 119. It is understood that the included figures are not drawn to scale and that the clearance between capsule bodies 118 and conduits 112 may be minimal in exemplary embodiments. It will often be desirable to minimize the clearance between capsule bodies 118 and conduits 112 so that capsule bodies 118 and capsule caps 117 are properly aligned when they are coupled. In such embodiments, there will be minimal leakage of air past capsule bodies 118 as they move within conduits 112. When the clearance between capsule bodies 118 and conduits 112 is minimized, the majority of air contained in conduits 112 will be displaced toward engagement surface 119 as capsule bodies 118 move within conduits 112.

When engagement surface 119 is not in contact with engagement surface 129 (of cap plate 120), the air in conduits 112 can be displaced to atmosphere via the ends of conduits 112 that extend to engagement surface 119. However, when engagement surfaces 119 and 129 are in contact (e.g., as shown in FIG. 3), the majority of the air may not be displaced to atmosphere via the ends of conduits 112 if engagement surfaces 119 and 129 are engaged and form a sealing interface that restricts air flow.

If engagement surfaces 119 and 129 form a sealing interface and capsule bodies 118 are moved towards capsule caps 117, pressure can build between capsule bodies 118 and caps 117. When capsules are formed by coupling capsule bodies 118 and capsule caps 117 without a way to vent conduits 112, air can be compressed within the capsule creating positive pressure. This positive pressure can contribute to capsules popping open or leakage on liquid filled capsules.

In certain embodiments, capsule bodies 118 are moved within conduit 112 so that capsule bodies 118 are proximal to engagement surface 119 before engagement surface 119 is engaged with engagement surface 129. In certain embodiments, capsule bodies 118 are moved within conduit 112 so that capsule bodies 118 are essentially flush with engagement surface 119 before engagement surface 119 is engaged with engagement surface 129. This can allow air within conduit 112 to be vented to atmosphere without the need for pressure relief cavities.

In order to avoid an increase in pressure in conduit 112 (and capsule bodies 118 and capsule caps 117) as engagement surfaces 119 and 129 are engaged, closing block 110 may include a pressure-relief cavity 127. In the embodiment shown, pressure-relief cavity 127 is in fluid communication with conduits 112 and the surrounding atmosphere. Pressure-relief cavity 127 therefore allows air that is contained in conduit 112 to be vented to atmosphere as capsule body 118 is displaced towards engagement surface 119. This will reduce the pressure buildup created in a capsule formed by the coupling of capsule body 118 and capsule cap 117. In specific embodiments, pressure-relief cavity 127 is formed by drilling a hole from the side of closing block 110 towards conduit 112 until the drilled hole reaches conduit 112. In certain embodiments, pressure-relief cavity 127 may extend from one side of closing block 110 to the opposite side of closing block 110.

In certain embodiments, a closing block and/or backing block may be coupled to a vacuum system, as described in more detail below. In the embodiment shown in FIGS. 2-4, backing block 150 is located above cap plate 120. During operation, backing block 150 includes supports 153 to restrict caps 117 from being moved axially when capsule bodies 118 are coupled to caps 117. In the embodiment shown, backing block 150 comprises a cavity 152 that is coupled to a vacuum system 151. Cavity 152 is also in fluid communication with conduits 116. Vacuum system 151 is configured to reduce the pressure in cavity 152 and conduits 116. In specific embodiments, conduits 116 have pressure-relief cavities (including for example, axial channels or grooves running along the conduit) that allow air or other gasses trapped within conduit 116 to travel from engagement surface 129 towards cavity 152. As capsule body 118 is moved within conduit 112, the air can be directed into cavity 152 and vacuum system 151. In certain embodiments, cavity 152 may be vented to atmosphere rather than being coupled to vacuum system 151. The use of vacuum system 151 may assist in lowering the pressure in cavity 152 and reducing an unwanted increase in pressure in conduits 112 and 116.

Figure 5A:
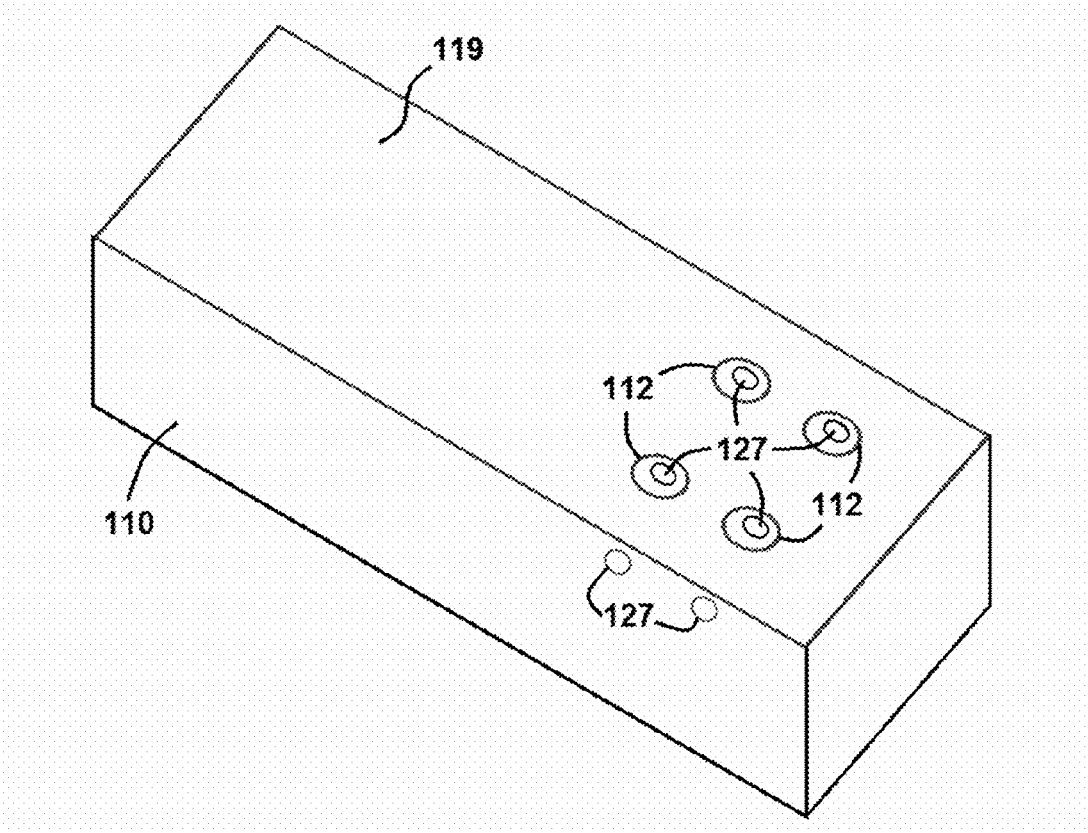
FIG. 5A shows a perspective view of a closing block of a system according to one or more examples of embodiments of the present invention.

Referring now to FIG. 5A, a perspective view of one embodiment of closing block 110 illustrates conduits 112 and pressure-relief cavities 127. In this embodiment, four conduits 112 are shown, but it is understood that other embodiments may comprise less than or greater than four conduits 112 in closing block 110. As shown in FIG. 5A, pressure-relief cavity 127 forms a conduit that extends from the outer edge of closing block 110 to conduit 112. In the embodiment shown in FIG. 5A, pressure-relief cavity 127 forms an aperture on the wall of conduit 112 at the location where pressure-relief cavity 127 intersects conduit 112.

In exemplary embodiments, pressure-relief cavities extend from one side of closing block 110 to the opposite side of closing block 110 and intersect conduits 112. Conduits 112 comprise a circular cross-section in the portions where pressure-relief cavities 127 do not intersect conduits 112. The circular cross-section provides alignment for capsule body 118 (which also comprises a circular cross-section in exemplary embodiments). In the portions where pressure-relief cavities 127 intersects conduits 112, conduits 112 do not comprise a circular cross-section. This allows capsule body 118 to move towards cap 117 without building up excessive pressure in a capsule formed by coupling body 118 and cap 117.

Figure 5B:
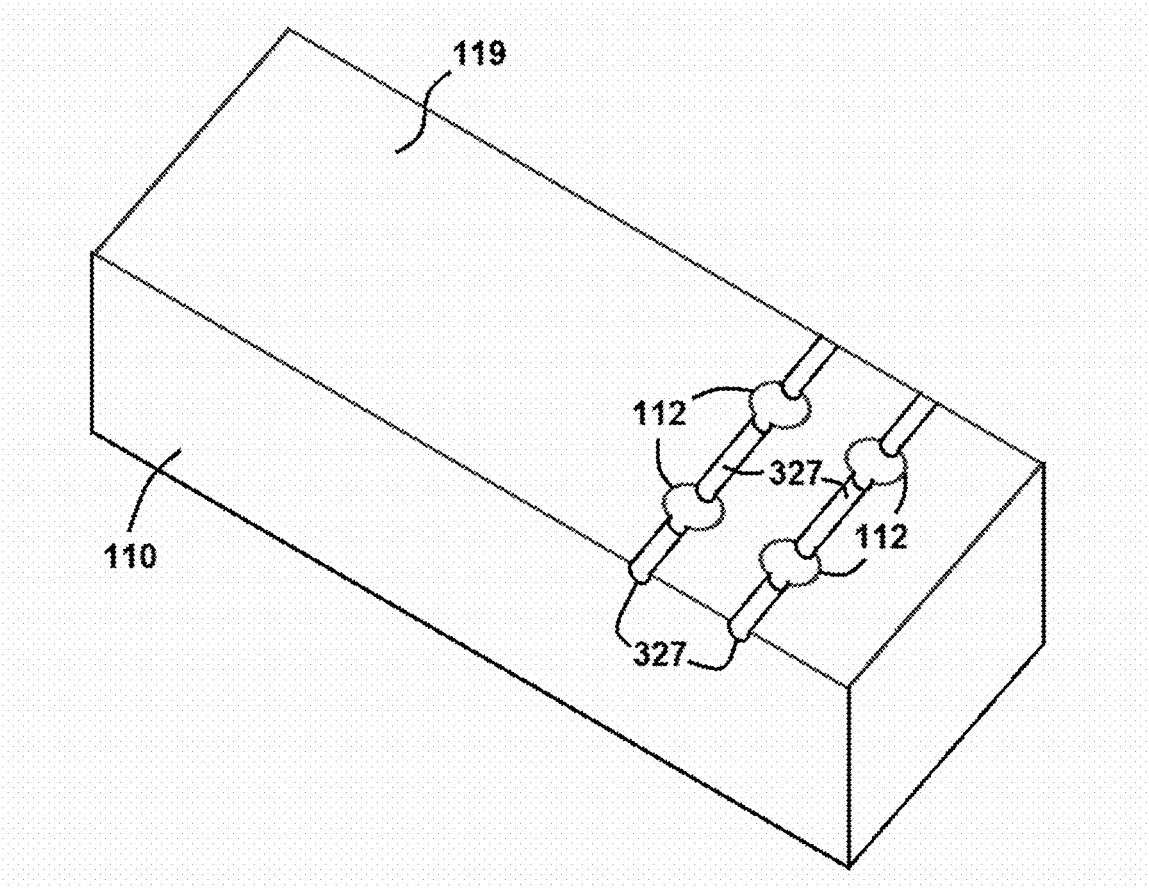
FIG. 5B shows a perspective view of a closing block of a system according to one or more examples of embodiments of the present invention.

In specific exemplary embodiments, pressure-relief cavities 127 are proximal to engagement surface 119. Such a configuration can allow pressure-relief cavities 127 to relieve pressure proximal to the location where capsule bodies 118 are coupled to capsule caps 116. This can reduce the likelihood that unwanted pressure will form when capsules are created by coupling capsule bodies 118 and caps 116. It is understood that other embodiments may comprise additional pressure-relief cavities, including for example, additional holes drilled from the side of closing block 110 and along the length of conduits 112. A specific embodiment is shown in FIG. 5B, a series of slots milled into engagement surface 119 form pressure relief cavities 327. Pressure relief cavities 327 function similar to the previously-described pressure relief cavities 127. By extending into engagement surface 119, pressure relief cavities 327 are capable of venting conduits 112 while capsule bodies 118 are moving within conduits 112 until capsule bodies reach engagement surface 119. It is understood that the exemplary embodiments shown in the figures are merely illustrative of a number of different configurations that are within the scope of the present invention.

Figure 6:
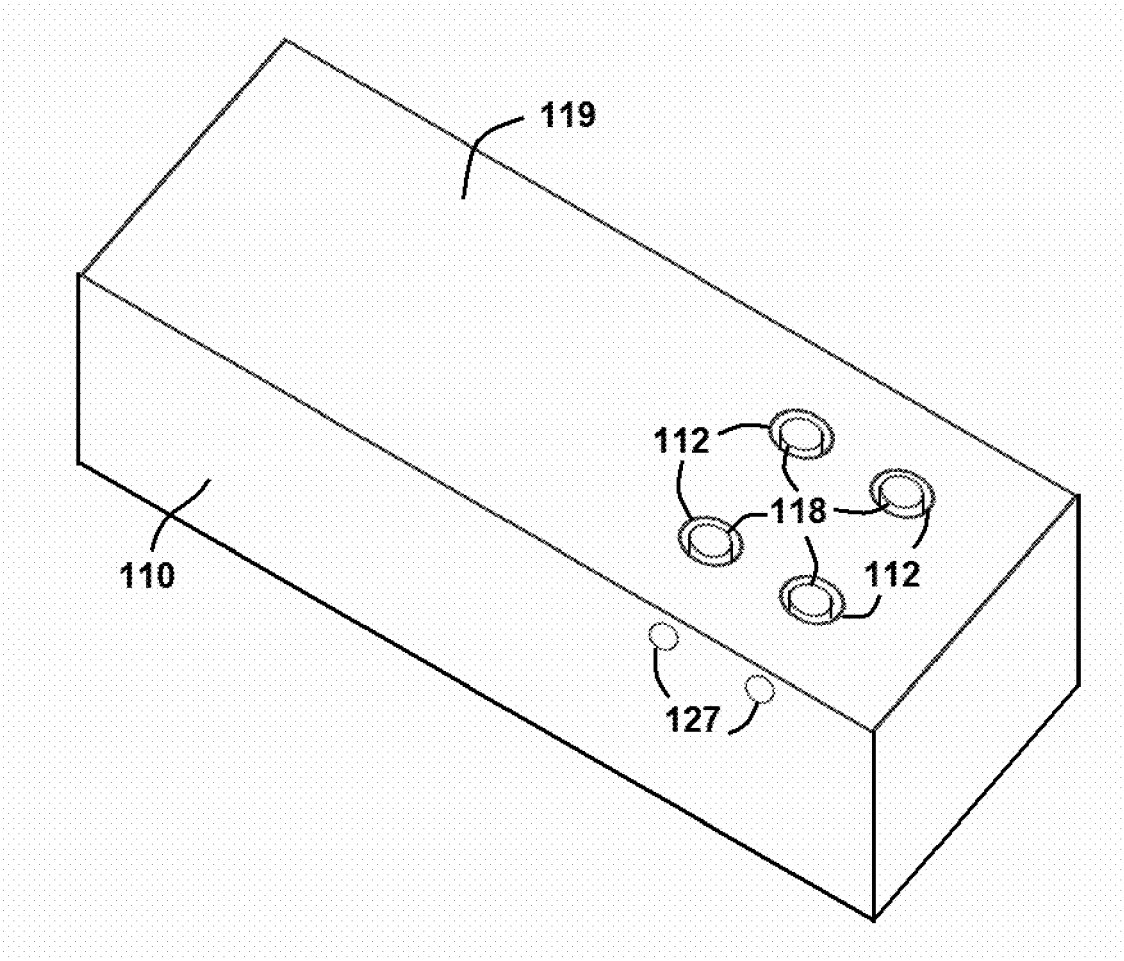
FIG. 6 shows a perspective view of the closing block of the embodiment of FIG. 5A with capsule bodies visible.

Referring now to FIG. 6, capsule bodies 118 are shown after they have been displaced along conduits 112 towards engagement surface 119. Although not visible in conduits 112 (due to the presence of capsule bodies 118 proximal to engagement surface 119), pressure-relief cavities 127 are in fluid communication with conduits 112.

Figure 7:
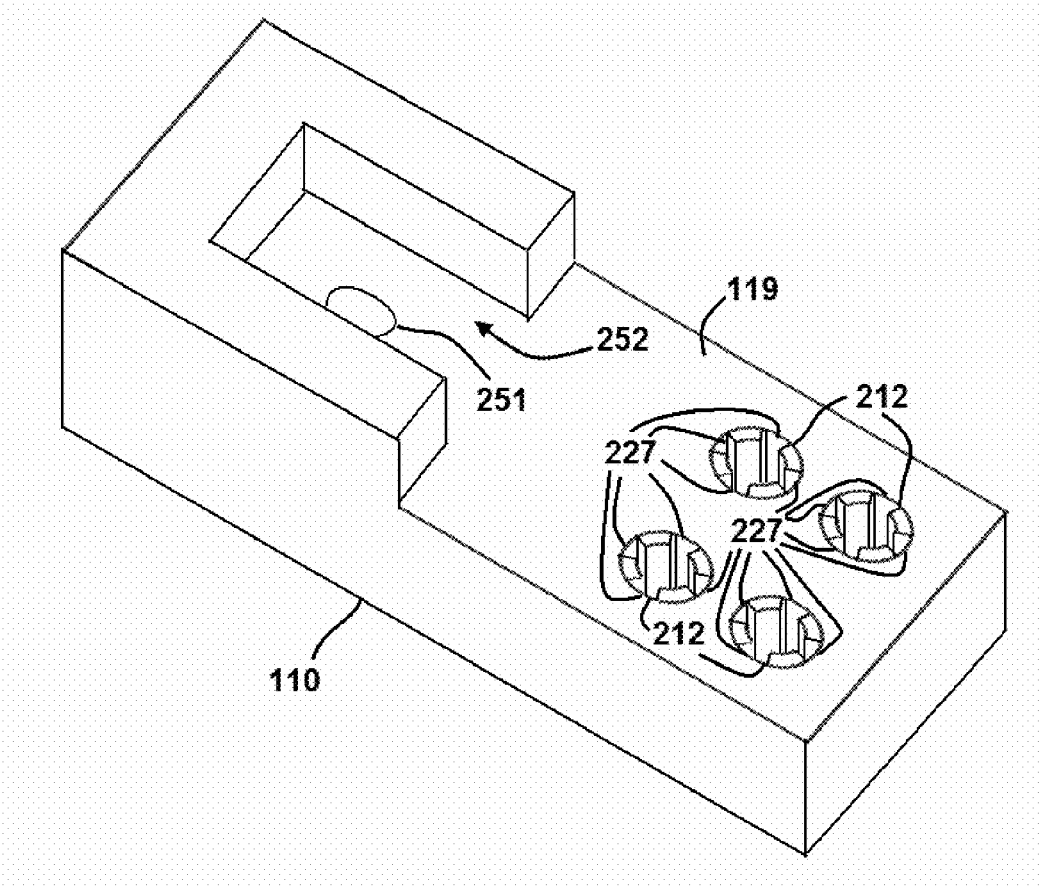
FIG. 7 shows a perspective view of a closing block of a system according to one or more examples of embodiments of the present invention.

Referring now to FIG. 7, another embodiment of closing block 110 comprises a different configuration of pressure-relief cavities. In this embodiment, a plurality of pressure-relief cavities 227 are created by channels or grooves that run along the length of conduits 112. While multiple pressure-relief cavities 227 are shown in each conduit 112 in this exemplary embodiment, it is understood that other exemplary embodiments may comprise a single pressure relief cavity in a conduit. Conduits 112 can be configured so that they still align capsule bodies 118 via the segment of the conduit disposed between the axial channels formed by pressure relief cavities 227. However, as seen when looking down on conduits 112 (e.g., looking down on engagement surface 119), conduits 112 do not comprise a circular cross-section. This configuration allows capsule body 118 (which comprises a circular cross-section in exemplary embodiments) to move within conduit 112 without displacing air. Capsule body 118 can therefore move towards cap 117 without building up excessive pressure in a capsule formed by coupling body 118 and cap 117.

Figure 8:
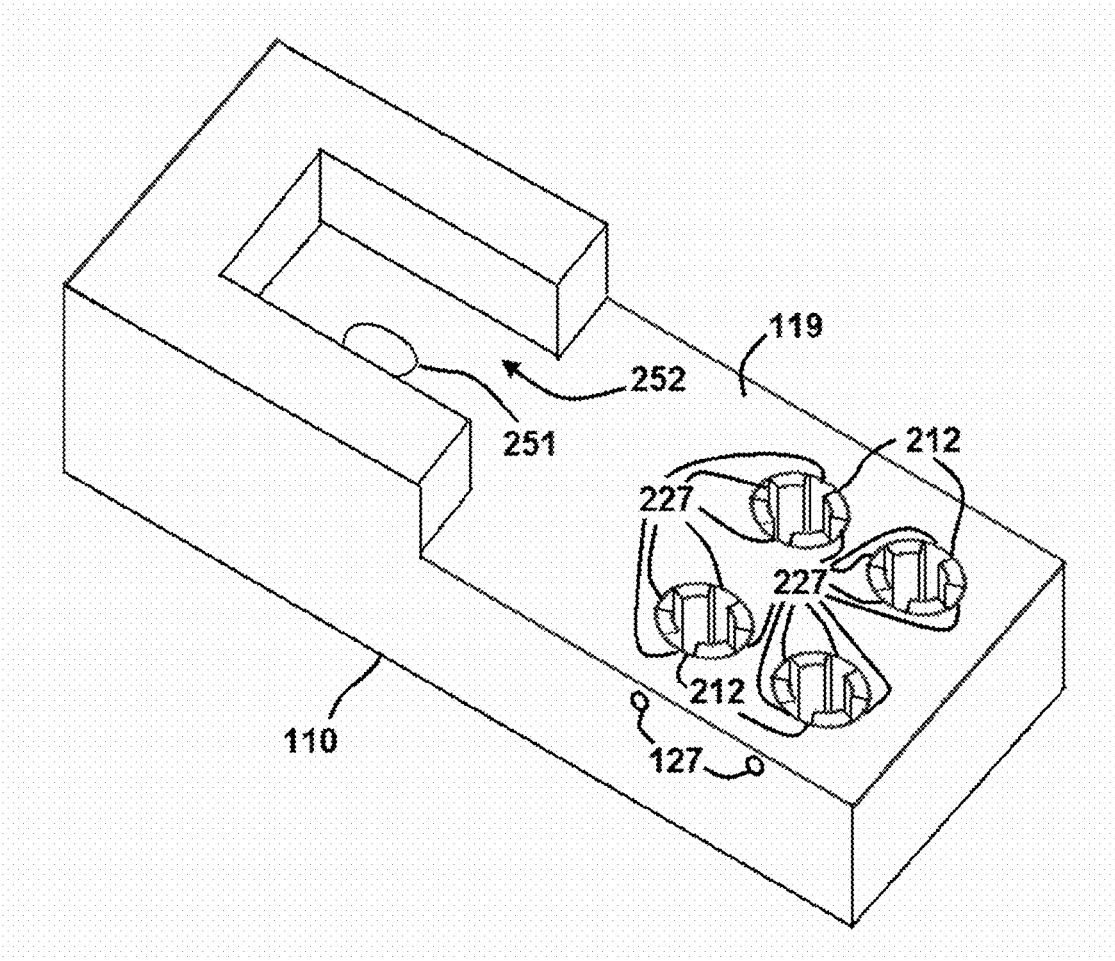
FIG. 8 shows a perspective view of a closing block of a system according to one or more examples of embodiments of the present invention.

In certain embodiments, pressure-relief cavities 227 may also be used in conjunction with pressure-relief cavities 127, as shown in FIG. 8. During operation, relief cavities 227 can allow air to vent to atmosphere (e.g., via pressure-relief cavities 127) as capsule bodies 118 are moved within conduits 112. In certain embodiments, the surface of closing block 110 that is opposite of engagement surface 119 (e.g., the bottom surface when closing block 110 is positioned as shown in FIG. 7) may be exposed to atmosphere when capsule body 118 is coupled to capsule cap 117. In such embodiments, pressure-relief cavities 227 can allow air within conduit 112 to vent to atmosphere via the surface of closing block 110 that is opposite of engagement surface 119.

Referring back now to the embodiments shown in FIGS. 5A, 5B and 6, relief cavities 127 and/or 327 may also be configured to allow air within conduits 112 to be directed towards a vacuum system. For example, conduits 116 in cap plate 120 may also comprise channels or grooves that can allow air to be directed from conduits 112, through conduits 116 and into cavity 152 and vacuum system 151.

In addition, pressure-relief cavities 227 can be configured to allow air from conduits 112 to be directed to a vacuum system coupled to closing block 110. As shown in FIGS. 7 and 8, closing block 110 may comprise a chamber 252 with an aperture 251 that can be coupled to a vacuum system (not shown). In embodiments utilizing channels 227 and a vacuum system coupled to closing block 110, a plate (not visible in the figures) may be placed on the underneath side of block 110 to seal off conduits 212 from atmosphere and allow a sufficient vacuum to be established.

Figure 9:
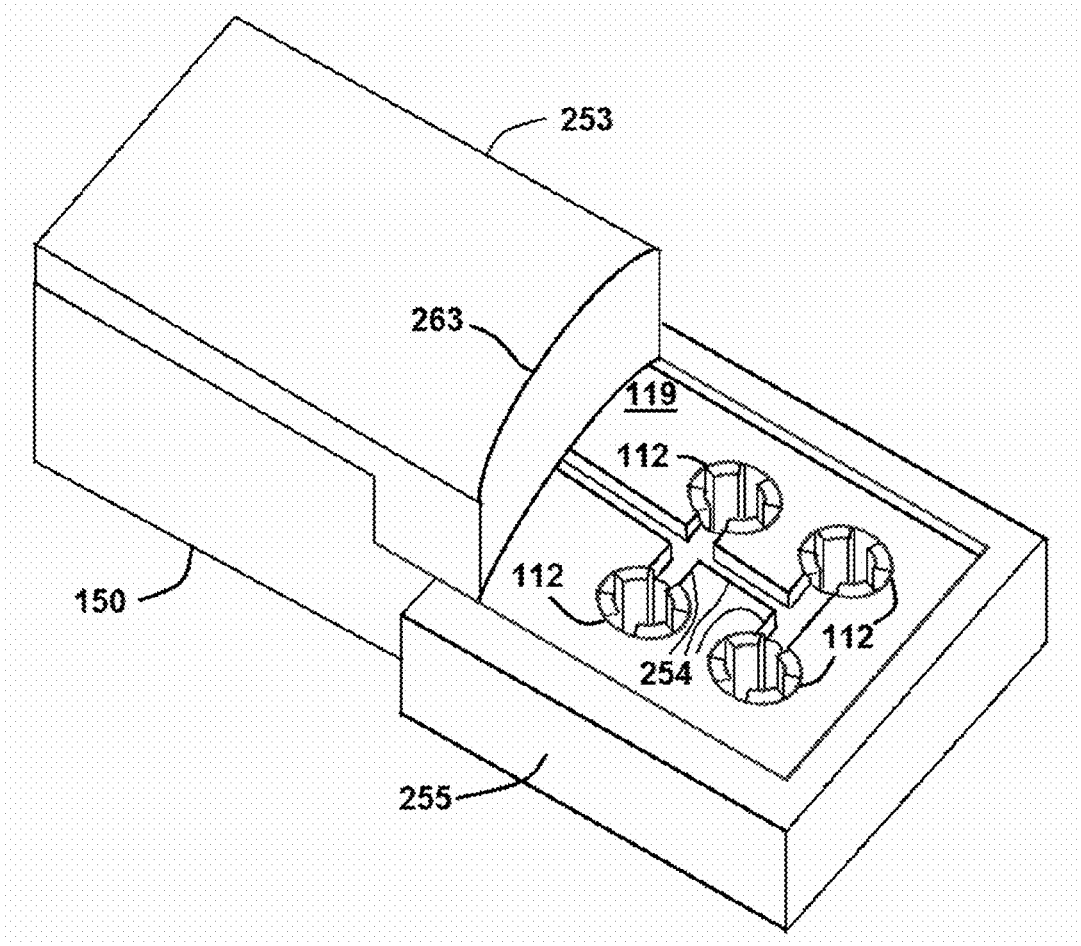
FIG. 9 shows a perspective view of the closing block of FIG. 8 with a hood and seal.

As shown in FIG. 9, a cover 253 may be placed over chamber 252. In the embodiment shown in FIG. 9, closing block 150 comprises a series of channels 254 in engagement surface 119 that lead to chamber 252. In the embodiment shown in FIG. 9, the channels 254 are in fluid communication with pressure-relief cavities 227 (not labeled in FIG. 9 for purposes of clarity) and therefore allow air from conduits 112 to be directed to chamber 252. A seal 255 can extend around the perimeter of closing block 150 to help direct any air toward chamber 252 and a vacuum system (if used). Cover 253 may comprise a curved portion 263 configured to match the outer perimeter of cap plate 120 and assist in directing air from conduit 112 to chamber 252. It is understood that cover 253 and seal 255 may be used with other embodiments incorporating a different configuration of pressure-relief cavities, including for example, those shown in FIGS. 5A, 5B and 6.

It is understood that in other embodiments, channels 254 may be in fluid communication with chamber 252 and with conduits 112 that do not comprise pressure relief cavities 227. In such embodiments, the vacuum source coupled to chamber 252 will remove air displaced with conduit 112 as capsule body 118 is moved within conduit 112. This vacuum actuation will reduce the pressure increase caused by the displacement of capsule body 118 towards capsule cap 117.

In certain embodiments, closing block 110 may be comprised of a porous material (including, for example, a sintered metal or a porous ceramic). In such embodiments, the pressure relief cavities may comprise voids in the porous material rather than specific channels or conduits formed in closing block 110. Such embodiments can allow for air at an elevated pressure to be diffused through the porous material as the capsule body 118 and cap 117 are brought together. In such embodiments, the pressure relief cavities may not be visible to the naked eye, but can comprise multiple voids within closing block 110 that allow air to be directed from conduit 112 to an outer surface of closing block 110 and to the outside environment (or a vacuum source).

Figure 10:
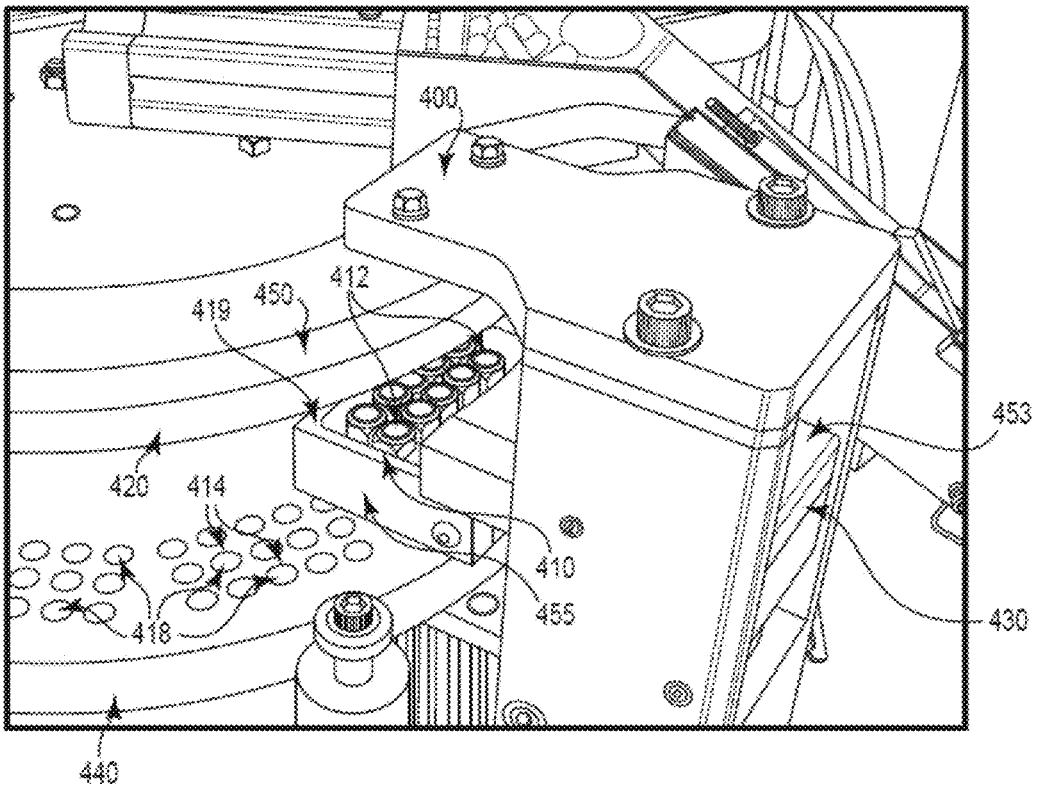
FIG. 10 shows a perspective view of a system according to one or more examples of embodiments of the present invention.

A specific embodiment of the present disclosure comprises an F-40 capsule filling machine (available from Shionogi Qualicaps, Whitsett, N.C.) with certain components modified and/or replaced to provide the features described herein. Referring to FIG. 10, for example, a specific embodiment comprises a system 400 comprising a closing block 410, a cap plate 420, an actuator 430, a body plate 440 and a backing block 450. Components of the system shown in FIG. 10 are generally equivalent to previously-described components with similar reference numbers. For example, component "4XX" is generally equivalent to component "1XX" in previously-described embodiments.

As shown in FIG. 10, capsules 418 are visible in conduits 414 of body plate 410 before they are directed to closing block 410. In addition, closing block 410 comprises a seal 455 and a cover 453 configured to provide a sealed chamber when engagement surface 419 engages cap disk 420. This can allow air expelled from conduits 412 (e.g., as capsule bodies 418 are directed upwards through conduits 412) to be directed to atmosphere or to a vacuum system. In the embodiment shown, engagement surface 419 comprises the outer perimeter of backing block 450 rather than the entire upper surface.

Figure 11:
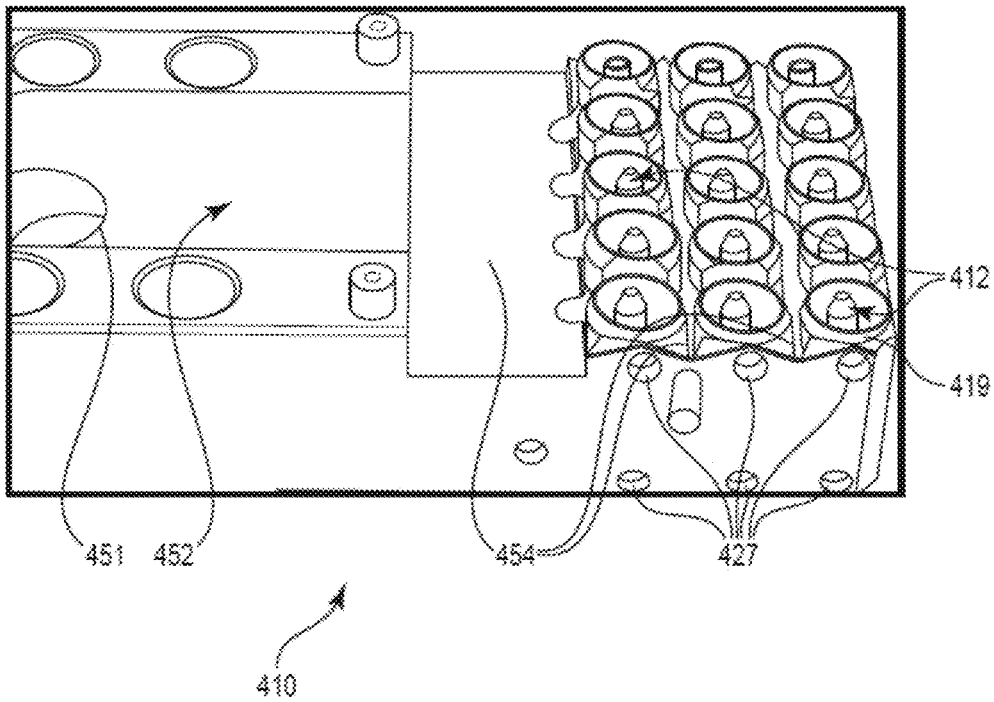
FIG. 11 shows a perspective view of a closing block of a system according to one or more examples of embodiments of the present invention.

Referring now to FIG. 11, a more detailed view of closing block 410 illustrates a plurality of conduits 412 in a 5×3 grid. In this embodiment, pressure-relief cavities 427 are formed by drilling holes from one side of closing block 410, through conduits 412 to the opposing side of closing block 410. It is understood that in other embodiments, the number and location of the holes may vary from that shown in the embodiment of FIG. 11. As shown in this embodiment, pressure-relief cavities 427 are formed near engagement surface 419. This can allow pressure-relief cavities 427 to vent air from conduits 412 when capsule bodies 418 are proximal to capsule caps 417 and reduce the likelihood that excess pressure will be created in a capsule. Channels 454 leading to chamber 452 are also visible in the embodiment shown in FIG. 11. In the specific embodiment shown, a portion of conduits 112 extend above channels 454 and pressure-relief cavities 427 intersect conduits 112 in the portion that extends above channels.

Figure 12:
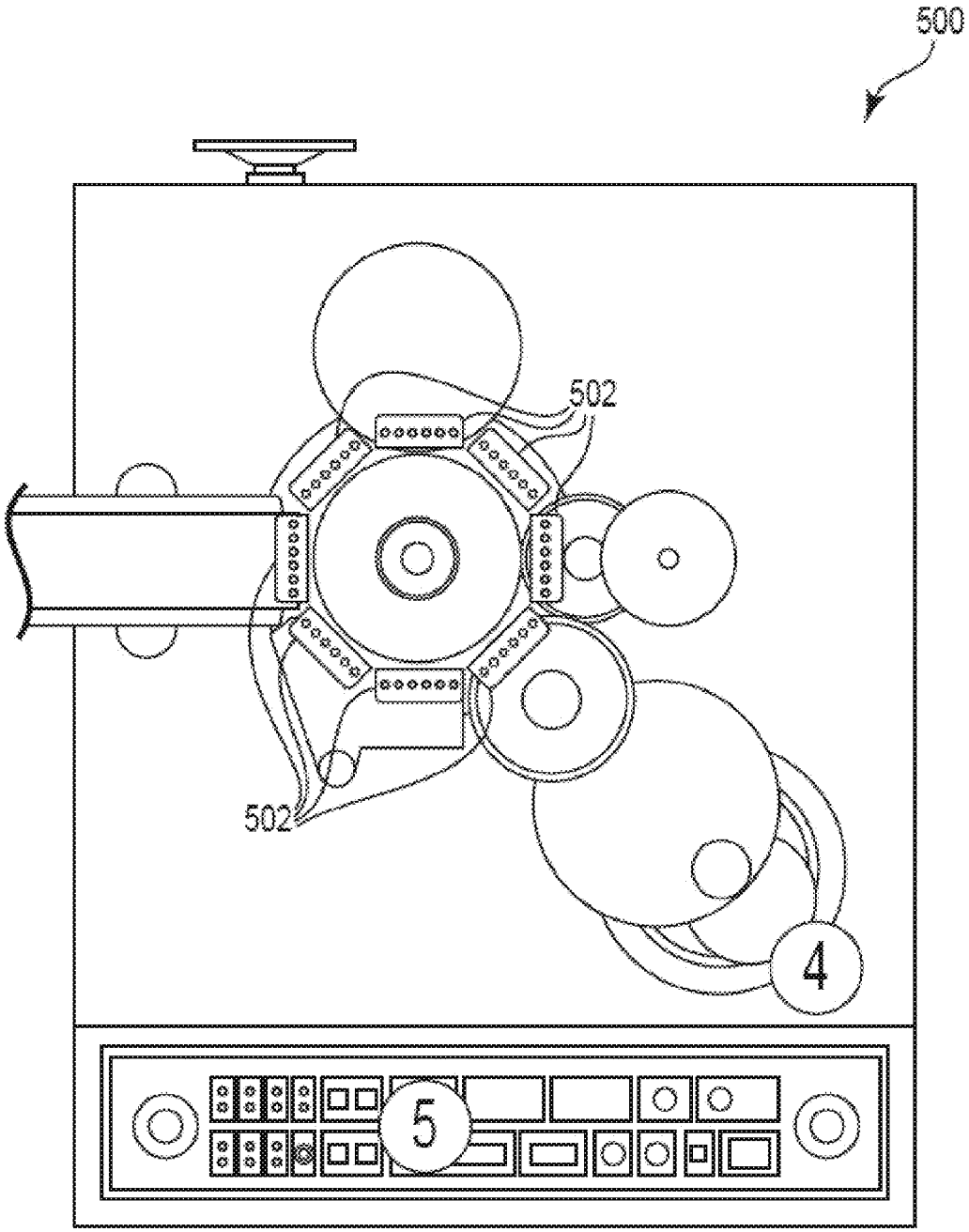
FIG. 12 is a top view of a specific embodiment of a capsule system.
Figure 13:
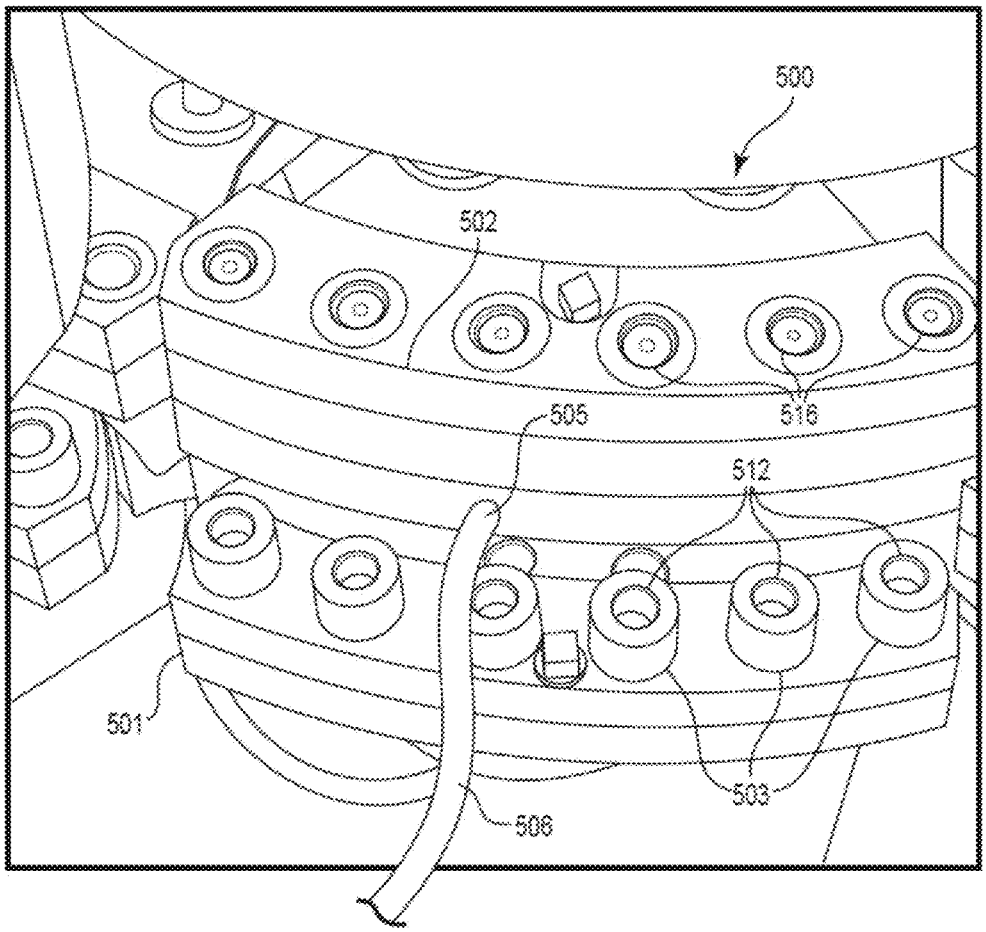
FIG. 13. is a perspective view of a specific embodiment of a capsule system.

Referring now to FIGS. 12 and 13, a top and perspective view of a specific embodiment of capsule system 500 is provided. System 500 operates in a manner generally similar to previously-described embodiments, but includes different components and aspects of operation. For example, rather than comprising a body disk and a cap disk, system 500 comprises a plurality of body segments 501 and cap segments 502. In addition, system 500 comprises a sealing member 505 that extends from cap segment 502 and is configured to engage body segment 501.

As shown in FIG. 13, a body segment 501 comprises a plurality of extensions 503 that extend towards cap segment 502. In certain embodiments, during operation, a capsule body will be flush with the upper surface of extension 503 (e.g., the surface that is closest to cap segment 502) when body segment 501 is moved towards cap segment 502. Therefore, the capsule body will not translate within the conduit 512 that extends through body segment 501. In other embodiments, a capsule body may be slightly recessed from the upper surface of extension 503 when body segment 501 is moved towards cap segment 502.

As shown in FIG. 13, a sealing member 505 extends down from cap segment 502 towards body segment 501. Sealing member 505 can be coupled to a conduit 506 that is coupled to a vacuum source (not shown). During operation, the vacuum source can operate to pull a vacuum on sealing member 505 and reduce the pressure at the interface between body segment 501 and cap segment 502.

Figure 14:
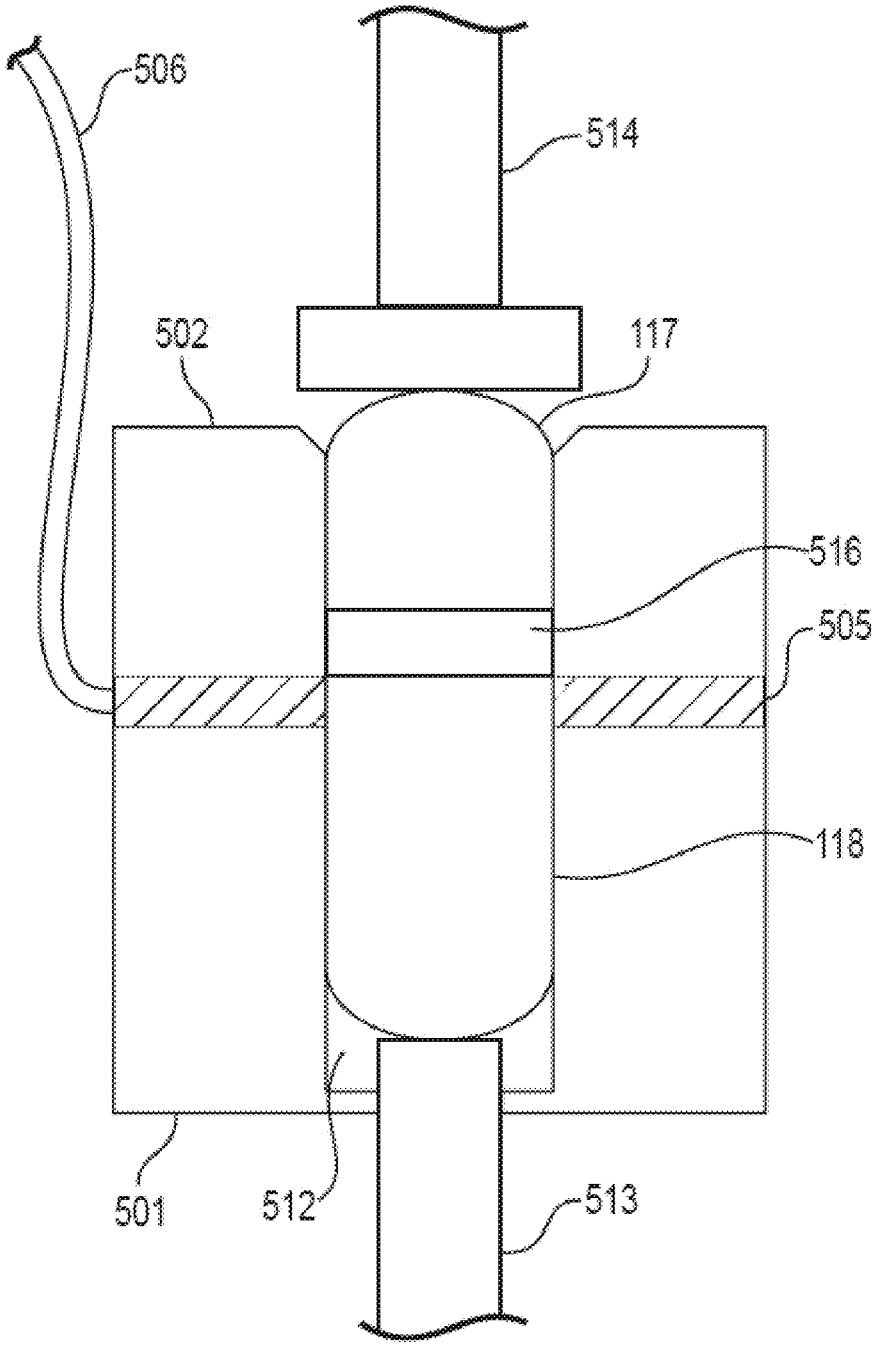
FIG. 14. is a cross section of a specific embodiment of a capsule system.

Referring now to FIG. 14, a partial cross section view of system 500 shows body segment 501 engaged with sealing member 505. In this embodiment, body segment 501 comprises a conduit 512 configured to align capsule body 118 with capsule cap 117. Capsule segment 502 similarly comprises a conduit 516 configured to align capsule cap 117 with capsule body 118. In this view, body segment 501 has been translated so that it is engaged with sealing member 505, and capsule body 118 is in the process of being moved (via rod 513) towards capsule cap 117. Capsule cap 117 can be held in place by a rod 514 during the engagement with capsule body 118.

As capsule body 118 is directed up towards capsule cap 117, a vacuum can be placed on sealing member 505 via conduit 506 and the vacuum source. This can reduce the potential for pressure to increase in the interface between capsule body 118 and capsule cap 117 and allow for a successful coupling of the components.

Although various representative embodiments of this invention have been described above with a certain degree of particularity, those skilled in the art could make numerous alterations to the disclosed embodiments without departing from the spirit or scope of the inventive subject matter set forth in the specification and claims. For example, while certain elements of exemplary embodiments have been described as a "block" or "plate", this nomenclature is not intended to limit embodiments of the invention to elements with a specific geometric configuration. Other embodiments may have components with different geometric configurations than those shown in the attached figures.

Joinder references (e.g., attached, coupled, connected) are to be construed broadly and may include intermediate members between a connection of elements and relative movement between elements. As such, joinder references do not necessarily infer that two elements are directly connected and in fixed relation to each other. In some instances, in methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to preferred embodiments, persons skilled in the art will recognize that changes may be made in form and detail without departing from the spirit and scope of the invention.

REFERENCES

The following references are incorporated by reference herein:

U.S. Pat. No. 3,554,412;
U.S. Pat. No. 4,731,979;
U.S. Pat. No. 5,321,932;
U.S. Pat. No. 5,797,248;
U.S. Pat. No. 6,286,567;
U.S. Pat. No. 6,901,972.

What is claimed is:

1. A system for coupling a cap and body of a capsule, the system comprising:

a first block comprising a first engagement surface;

a first plate comprising a second engagement surface;

a first conduit extending from the first engagement surface into the first block; and a second conduit extending from the second engagement surface into the first plate, wherein: the system is configured to move the first engagement surface toward the second engagement surface and away from the second engagement surface; and the first conduit comprises a pressure-relief cavity;

wherein the pressure-relief cavity is formed by a third conduit from an outer wall of the first block to the first conduit.

2. The system of claim 1 wherein the pressure-relief cavity is vented to atmosphere.

3. The system of claim 1 wherein the pressure-relief cavity is coupled to a vacuum source.

4. The system of claim 3 wherein the first block comprises a seal extending partially around the perimeter of the block.

5. The system of claim 3 wherein the first block comprises a chamber coupled to the vacuum source.

6. The system of claim 1 wherein the pressure-relief cavity comprises an axial channel in the first conduit.

7. The system of claim 1 wherein the pressure relief cavity is proximal to the first engagement surface.

8. A system for coupling a cap and body of a capsule, the system comprising:

a first block comprising a first engagement surface;

a first plate comprising a second engagement surface;

a first conduit extending from the first engagement surface into the first block; and a second conduit extending from the second engagement surface into the first plate, wherein:

the system is configured to move the first block toward the first plate and away from the first plate;

a first portion of the first conduit comprises a circular cross-section;

a second portion of the first conduit comprises a non-circular cross-section; and a pressure-relief cavity formed by a third conduit from an outer wall of the first block to the first conduit.

9. The system of claim 8 wherein the second portion of the first conduit is vented to the atmosphere.

10. The system of claim 8 wherein the second portion of the first conduit is coupled to a vacuum source.

11. The system of claim 8 wherein the second portion of the first conduit comprises an axial channel.

12. The system of claim 8 wherein the second portion of the first conduit comprises an aperture in the wall of the first conduit.

13. The system of claim 8 wherein the second portion of the first conduit is proximal to the first engagement surface.

14. A system for coupling a cap and body of a capsule, the system comprising:

a first block comprising a first engagement surface;

a first plate comprising a second engagement surface;

a first conduit extending from the first engagement surface into the first block; and a second conduit extending from the second engagement surface into the first plate, wherein:

the system is configured to move the first engagement surface toward the second engagement surface and away from the second engagement surface; and the first block is comprised of a porous material configured to allow air to diffuse from the first conduit to an outer surface of the first block.

15. The system of claim 14 wherein the porous material is a sintered material.

16. The system of claim 14 wherein the outer surface of the first block is exposed to the atmosphere.

17. The system of claim 14 wherein the outer surface of the first block is exposed to a vacuum system.

18. A method of coupling a capsule cap and a capsule body, the method comprising:

providing a first component configured to retain a capsule body, wherein the first component comprises a first conduit configured to align a capsule body;

providing a second component configured to retain a capsule cap, wherein the second component comprises a second conduit configured to align a capsule cap;

providing a pressure-relief cavity formed by a third conduit from an outer wall of the first component to the first conduit;

moving at least one of the capsule cap and the capsule body within the first conduit and the second conduit; and displacing air from the first or second conduit via the pressure-relief cavity.

19. The method of claim 18 wherein displacing air from the first or second conduit via the pressure-relief cavity comprises venting air from the first or second conduit via the pressure-relief cavity to atmosphere.

20. The method of claim 18 wherein displacing air from the first or second conduit via the pressure-relief cavity comprises directing the air to a vacuum source.

21. A method of coupling a capsule cap and a capsule body, the method comprising:

providing a first component configured to retain a capsule body, wherein the first component comprises a first conduit configured to align a capsule body;

providing a second component configured to retain a capsule cap, wherein the second component comprises a second conduit configured to align a capsule cap;

providing a first engagement surface on the first component and a second engagement surface on the second component, wherein the first engagement surface is configured to engage the second engagement surface when the first component is engaged with the second component;

providing a pressure-relief cavity formed by a third conduit from an outer wall of the first component to the first conduit;

displacing the capsule body within the first conduit so that the capsule body is proximal to the first engagement surface prior to the first engagement surface being engaged with the second engagement surface.

22. A system for coupling a cap and body of a capsule, the system comprising:

a body segment configured to retain a capsule body, wherein the body segment comprises a first conduit configured to align a capsule body;

a cap segment configured to retain a capsule cap, wherein the cap segment comprises a second conduit configured to align a capsule cap; and a sealing member coupled to the cap segment, wherein the body segment is configured to engage the sealing member when the body segment is translated towards the cap segment;

a pressure-relief cavity formed by a third conduit from an outer wall of the body segment to the first conduit;

a vacuum source coupled to the sealing member, wherein the vacuum source is configured to place a vacuum on the sealing member when the sealing member is engaged with the body segment.

23. The system of claim 22, further comprising a conduit coupling the vacuum source to the sealing member.

* * * * *